US007261299B1

(12) United States Patent
Chiu

(10) Patent No.: US 7,261,299 B1
(45) Date of Patent: Aug. 28, 2007

(54) JUMPING GAME USING BUILDING BLOCK-BASED STEPPING STONES

(76) Inventor: I-Cheng Chiu, 9F, No. 70 Sec. 5. Nan-King East Rd., Taipei (TW)

( * ) Notice: Subject to any disclaimer, the term of this patent is extended or adjusted under 35 U.S.C. 154(b) by 0 days.

(21) Appl. No.: 11/348,620

(22) Filed: Feb. 6, 2006

(51) Int. Cl.
*A63F 9/00* (2006.01)

(52) U.S. Cl. ..... 273/440; 273/449; 273/450; 273/459

(58) Field of Classification Search ..... 273/440, 273/449, 450, 459; 446/69, 117; 297/423.41
See application file for complete search history.

(56) References Cited

U.S. PATENT DOCUMENTS 1,490,201 A * 4/1924 Brown ..... 273/444
3,424,455 A * 1/1969 Dunson ..... 273/459
3,558,133 A * 1/1971 Reiner et al. ..... 273/444
3,761,084 A * 9/1973 Dieckmann ..... 273/444
5,505,462 A * 4/1996 Loewen ..... 273/440
5,749,555 A * 5/1998 Albrecht ..... 248/346.01
7,052,013 B2 * 5/2006 Olsen ..... 273/450
2005/0093244 A1 * 5/2005 Olsen ..... 273/450

* cited by examiner

*Primary Examiner*—Raleigh W. Chiu
(74) *Attorney, Agent, or Firm*—Pro-Techtor Int'l Services

(57) ABSTRACT

The present invention relates to a game tool for jumping building block-based stepping stones, comprising a plurality of stepping stone units that can be independently placed flat on the ground for children to step on and jump. As each stepping stone unit is triangularly tilted, a top surface of each stepping stone unit forms a different inclination by changing the combination at a different angle, thereby enhancing the difficulty level of the game. Therefore, it is possible to superimpose and pile up the stepping stone units at a different inclination. Moreover, an anti-slip piece having a different pattern is disposed on a top surface of each of the stepping stone units, thereby preventing slippage and achieving educational and recreational purposes.

5 Claims, 4 Drawing Sheets

JUMPING GAME USING BUILDING BLOCK-BASED STEPPING STONES

BACKGROUND OF THE INVENTION (a) Field of the Invention

The present invention relates to a game tool having stepping stone units capable of being superimposed and piled up to form building block-based stepping stones with top surfaces tilted at different inclinations and being independently placed flat on the ground for stepping, jumping, and enhancing a sense of equilibrium.

(b) Description of the Prior Art

General stepping stone jumping tools allow people to jump and play just like the stones along the river. The majority of conventional stepping stone tools are rectangular or circular in shape, such that they are unable to appeal to young children because of the visual appeal and structural changes they have elicited.

SUMMARY OF THE INVENTION

To overcome the abovementioned drawback, the primary object of the present invention is to provide a plurality of stepping stone units capable of being superimposed and piled up to form building block-based stepping stones and being independently placed flat on the ground for children to step on, jump, learn action programs, and enhance a sense of equilibrium and sensory integration.

Another object of the present invention is to provide an anti-slip piece having a different pattern disposed on a top surface of each of a plurality of stepping stone units for young children to step on and prevent slippage and to enhance the appearance of the product. Moreover, an anti-slip pad is disposed on a bottom rim of each stepping stone unit, such that when the stepping stone unit is placed flat on the ground, it can prevent the stepping stone unit from slippage and moving and prevent the user from falling down and getting hurt.

To enable a further understanding of the objectives and the technological methods of the invention herein, the brief description of the drawings below is followed by the detailed description of the preferred embodiments.

DETAILED DESCRIPTION OF THE PREFERRED EMBODIMENTS

Figure 1:
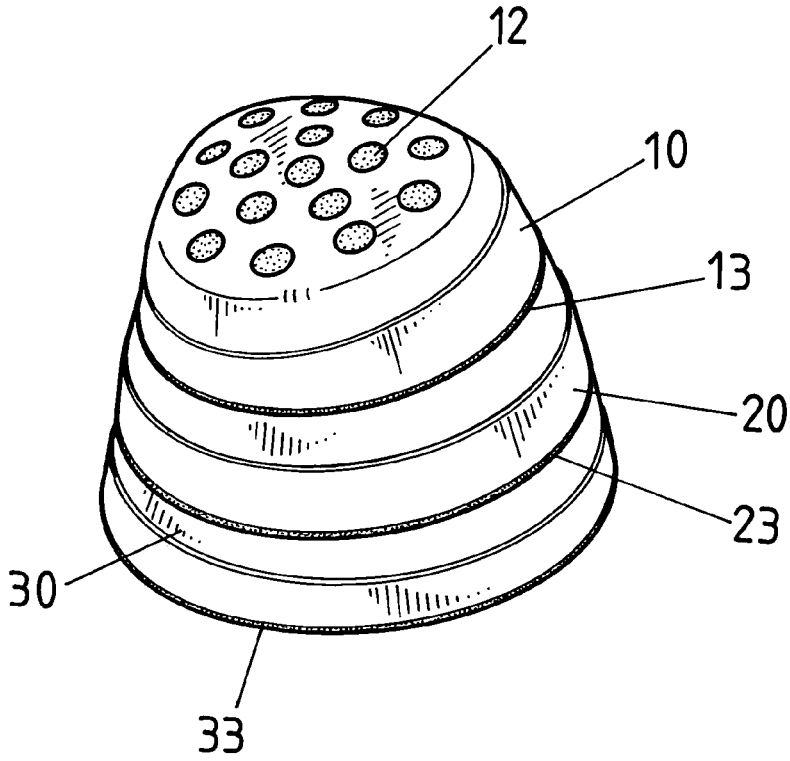
FIG. 1 shows an external view of the present invention.
Figure 3:
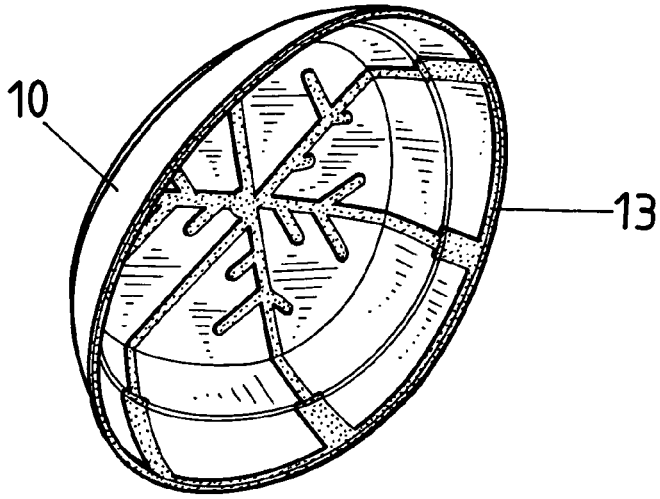
FIG. 3 shows an external bottom view of the top stepping stone unit of the present invention.
Figure 2:
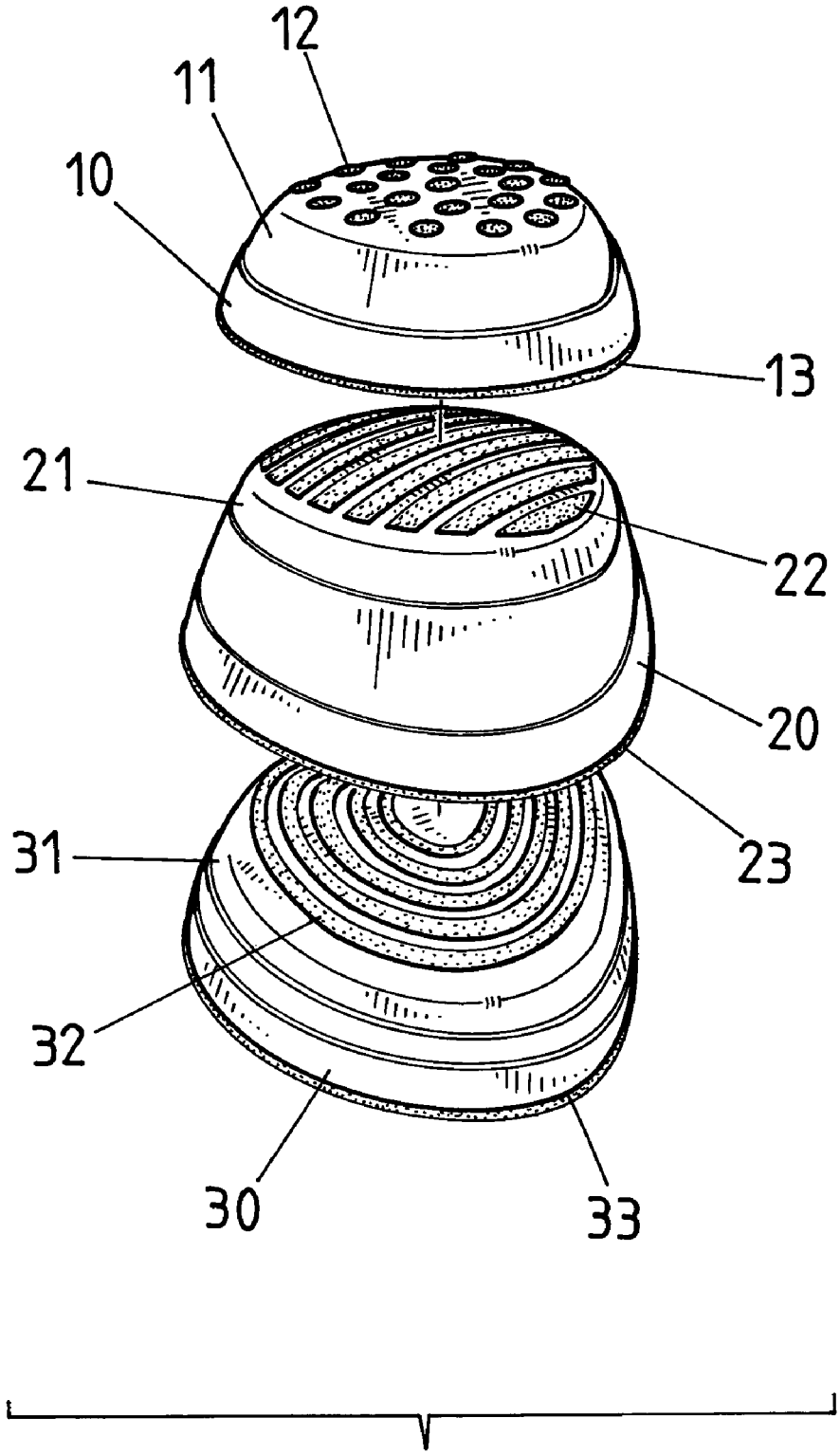
FIG. 2 shows an exploded view of the present invention.
Figure 4:
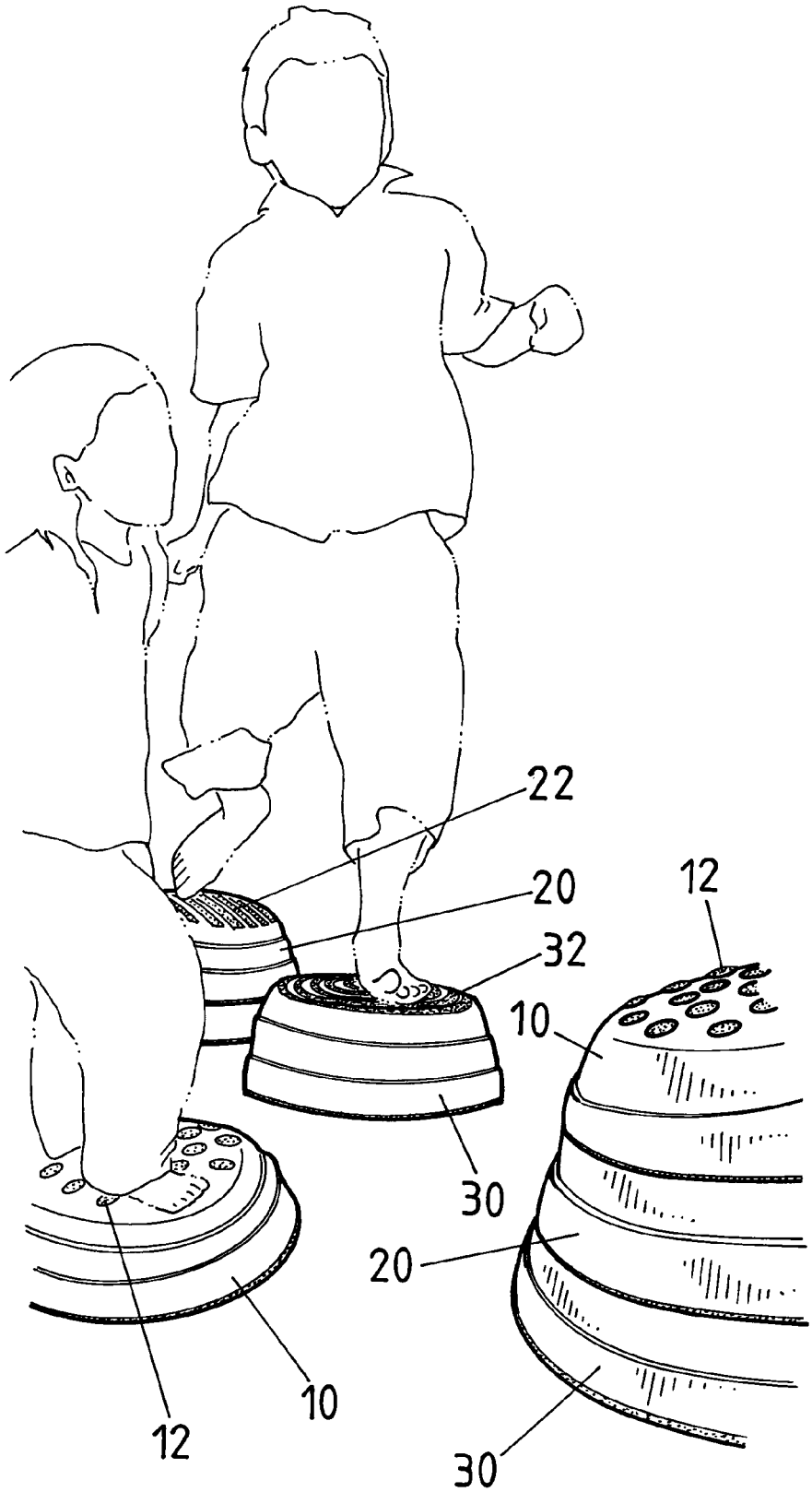
FIG. 4 shows an embodiment of the present invention.

Referring to FIG. 1 and FIG. 2, the present invention comprises three stepping stone units 10, 20, and 30. The rainbow-shaped building block-based stepping stones are primarily triangular in shape, with three combinations for each of the top, the middle, and the bottom stepping stone unit, such that the three stepping stone units make up nine (3×3) combinations. An indented rim 11, 21, and 31 is provided in a center at a side surface of each of the stepping stone units 10, 20, and 30, such that the indented rim 21 or 31 at a lower level can be inserted into the respective stepping stone unit 10 or 20 at an upper level. An anti-slip piece 12, 22, and 32 having a different pattern is protrudingly disposed on a top surface of each of the stepping stone units 10, 20, and 30, wherein the top anti-slip piece 12 is densely covered with dots, the middle anti-slip piece 22 is densely covered with long strips, and the bottom anti-slip piece 32 is densely covered with circular rings. Referring to the external bottom view of the top stepping stone unit 10 of the present invention in FIG. 3, it shows the distribution of the secondary injection molding of an anti-slip pad 12. An anti-slip pad 13, 23, and 33 is circumferentially disposed on a bottom rim of each of the stepping stone units 10, 20, and 30, such that when the stepping stone unit 10, 20, and 30 are independently placed flat on the ground as shown in FIG. 4 for young children to step on, each of the anti-slip pads 13, 23, and 33 can prevent slippage.

Figure 5:
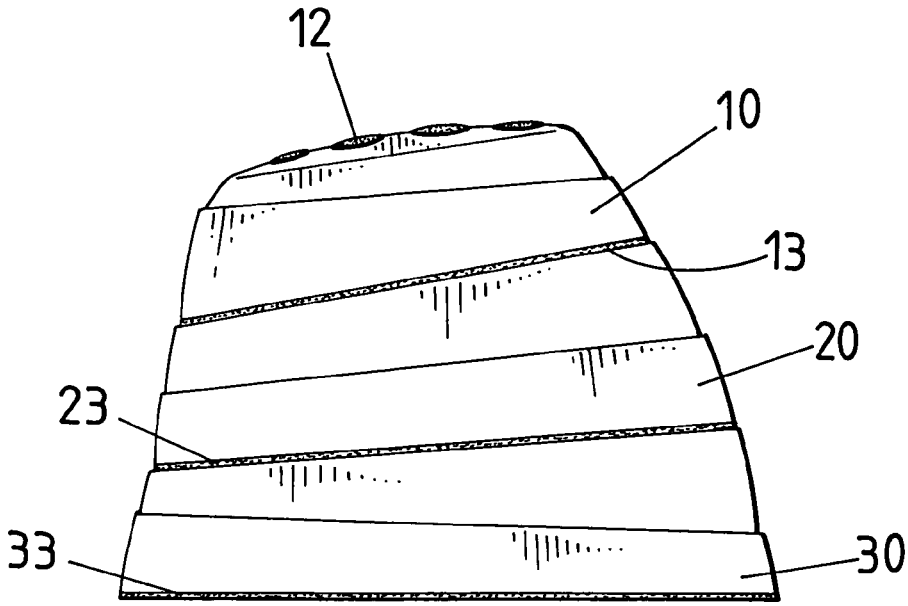
FIG. 5 is an isometric view showing one type of superimposition and piling up of the stepping stone units according to the present invention.
Figure 6:
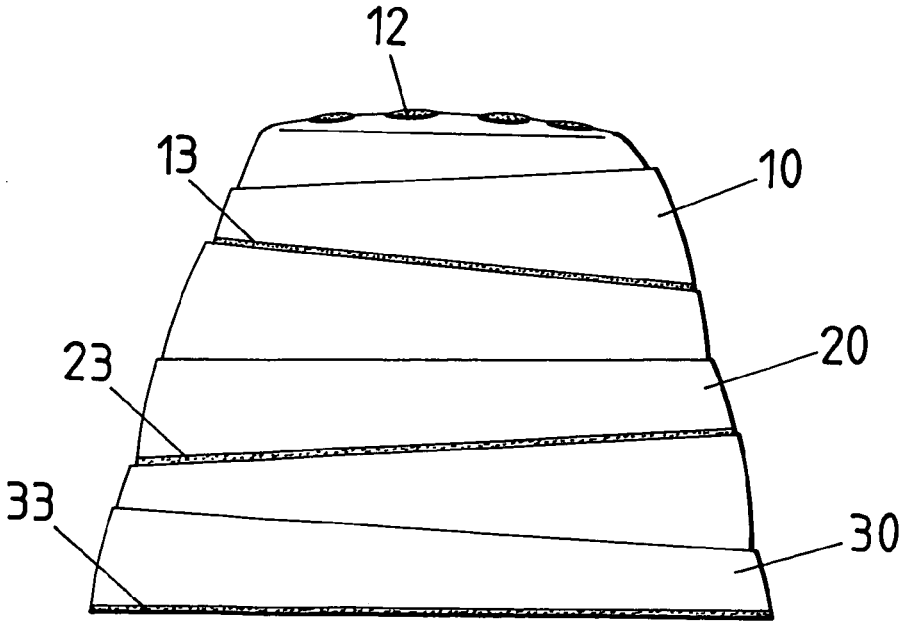
FIG. 6 is an isometric view showing another type of superimposition and piling up of the stepping stone units according to the present invention.

Referring to FIG. 5, with the help of their triangular tilted position, the top, middle, and bottom stepping stone unit 10, 20, and 30 can be piled up to form a type of building block-based stepping stones having an inclined top surface. Referring to FIG. 6, by changing the position at which the top, middle, and bottom stepping stone unit 10, 20, and 30 are combined, it is possible to pile them up to form another type of building block-based stepping stones having a top surface titled at a different inclination in order to enhance the difficulty level of the game.

In summary, the present invention provides a plurality of stepping stone units capable of being superimposed and piled up to form building block-based stepping stones disposed at different heights and inclination and being independently placed flat on the ground for young children to step on, jump, and enhance a sense of equilibrium and sensory integration.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A jumping game using building block-based stepping stones, comprising at least two stepping stone units, each having:

an indented rim in a center at a side surface of the stepping stone units, such that the stepping stone unit at an upper level is inserted over the respective indented rim of the stepping stone unit at a lower level, an anti-slip piece having one of a preselected set of patterns protrudingly disposed on a top surface of each of the stepping stone units, and an anti-slip pad circumferentially disposed on a bottom rim of each of the stepping stone units.

2. The jumping game using building block-based stepping stones as claimed in claim 1, wherein the stepping stones are triangularly tilted, with a plurality of combinations for the stepping stone units at an upper and a lower level.

3. The jumping game using building block-based stepping stones as claimed in claim 1, wherein the anti-slip piece of one of the stepping stone units is densely covered with dots.

4. The jumping game using building block-based stepping stones as claimed in claim 1, wherein the anti-slip piece of one of the stepping stone units is densely covered with long strips.

5. The jumping game using building block-based stepping stones as claimed in claim 1, wherein the anti-slip piece of one of the stepping stone units is densely covered with circular rings.

* * * * *